US007150272B2

(12) United States Patent
Persson

(10) Patent No.: US 7,150,272 B2
(45) Date of Patent: Dec. 19, 2006

(54) APPARATUS FOR AN INTERNAL COMBUSTION ENGINE

(75) Inventor: Per Persson, Partille (SE)

(73) Assignee: Volvo Lastvågnar AB, Göteborg (SE)

( * ) Notice: Subject to any disclaimer, the term of this patent is extended or adjusted under 35 U.S.C. 154(b) by 0 days.

(21) Appl. No.: 10/710,755

(22) Filed: Jul. 30, 2004

(65) Prior Publication Data

US 2005/0000498 A1 Jan. 6, 2005

Related U.S. Application Data

(63) Continuation of application No. PCT/SE02/02293, filed on Dec. 11, 2002, now abandoned.

(30) Foreign Application Priority Data

Feb. 4, 2002 (SE) ..... 0200314

(51) Int. Cl.

| | |
|---|---|
| ***F02M 25/07*** | (2006.01) |
| ***F01L 1/34*** | (2006.01) |
| ***F01L 31/16*** | (2006.01) |
| *F01L 1/08* | (2006.01) |
| *F01L 13/00* | (2006.01) |
| *F02D 13/02* | (2006.01) |

(52) U.S. Cl. ..... 123/568.14; 123/90.16; 123/90.22; 123/90.44; 123/316

(58) Field of Classification Search ..... 123/568.14, 123/90.14–90.18, 90.2, 90.27, 90.44, 90.45, 123/90.46, 90.48, 316, 90.22, 90.23
See application file for complete search history.

(56) References Cited

U.S. PATENT DOCUMENTS

| | | | | |
|---|---|---|---|---|
| 1,494,763 | A * | 5/1924 | West | 123/90.17 |
| 4,723,515 | A * | 2/1988 | Burandt | 123/90.16 |
| 5,456,224 | A * | 10/1995 | Riley | 123/90.16 |
| 5,960,755 | A * | 10/1999 | Diggs et al. | 123/90.15 |
| 6,152,104 | A | 11/2000 | Vorih et al. | |
| 6,688,267 | B1 * | 2/2004 | Raghavan | 123/90.16 |
| 6,877,469 | B1 * | 4/2005 | Lau | 123/90.16 |
| 2002/0088418 | A1 * | 7/2002 | Pierik | 123/90.45 |
| 2004/0168660 | A1 * | 9/2004 | Persson et al. | 123/90.17 |

FOREIGN PATENT DOCUMENTS

| | | |
|---|---|---|
| EP | 0961018 A1 | 12/1999 |
| JP | 11093715 | 7/1999 |
| JP | 11336599 | 3/2000 |
| WO | WO 0061930 A1 | 10/2000 |

* cited by examiner

*Primary Examiner*—Willis R. Wolfe, Jr.
(74) *Attorney, Agent, or Firm*—Novak Druce & Quigg, LLP

(57) ABSTRACT

Method and arrangement for delivering EGR gas to combustion spaces in a multi-cylinder, four-stroke internal combustion engine. Each cylinder, with an associated piston, has at least one inlet valve and at least one exhaust valve (10) for controlling fluid interconnection between the combustion space in the cylinder and an intake system and an exhaust system, respectively. A rotatable camshaft (18) having a cam curve (23) is designed to interact with a cam follower (17) for operation of the exhaust valve (10) during a first opening and closing phase. The cam curve (23) is also designed to interact with a second cam follower (20) during a second opening and closing phase which is phase-offset in relation to the first aforementioned opening and closing phase. This configuration facilitates the cylinder being connected to the exhaust system during the induction stroke, once the exhaust stroke is completed.

12 Claims, 3 Drawing Sheets

APPARATUS FOR AN INTERNAL COMBUSTION ENGINE

CROSS-REFERENCE TO RELATED APPLICATIONS

The present application is a continuation patent application of International Application No. PCT/SE02/02293 filed 11 Dec. 2002 now abandoned which was published in English pursuant to Article 21(2) of the Patent Cooperation Treaty, and which claims priority to Swedish Application No. 0200314-3 filed 4 Feb. 2002. Both applications are expressly incorporated herein by reference in their entireties.

TECHNICAL FIELD

The present invention relates to an apparatus for delivering EGR gas to combustion spaces in a multi-cylinder, four-stroke internal combustion engine. Each cylinder has an associated piston and at least one inlet valve and at least one exhaust valve for controlling the connection between the combustion space in the cylinder and an intake system and an exhaust system, respectively. A rotatable camshaft includes a cam curve or profile that is configured (designed) to interact with a cam follower for operating the exhaust valve during a first opening and closing phase.

BACKGROUND ART

The recirculation of exhaust gases, or so-called EGR (Exhaust Gas Recirculation), is a widely known method in which a proportion of the total exhaust gas flow from the engine is recirculated for mixing with intake air to the engine cylinders. This makes it possible to reduce the quantity of nitrogen oxide in the exhaust gases.

This recirculation usually occurs via shunt valves and lines extending on the outside of the engine, from the exhaust gas side to the intake side. In some cases, it is desirable, for reasons of space, to be able to achieve EGR mixing without such arrangements. For this purpose it has been proposed to achieve EGR mixing by using the usual engine inlet and exhaust valves for the return flow of exhaust gases from the engine exhaust manifold to the cylinders, and which is commonly referred to as Internal Exhaust Gas Recirculation (IEGR). The return flow can, in this case, be achieved by an additional opening of a valve, for example the exhaust valve, during the engine operating cycle.

In the case of supercharged diesel engines, however, it may be difficult to supply sufficient excess pressure on the exhaust gas side upstream of the turbocharger to transfer EGR gases to the intake side downstream of the compressor. However, there are pressure pulses on the exhaust gas side, while the inlet pressure is significantly more even. This means that the pressure peaks on the exhaust gas side can be higher than the inlet pressure even though the mean value is lower. If the exhaust valve is opened at such a time of peak pressure during the engine induction stroke, exhaust gases flow back into the cylinder.

The use of a two-position valve clearance, for example, a mechanically adjusted valve clearance combined with a hydraulically adjusted zero-clearance, which can be activated/deactivated according to the engine operating situation, switching between positive engine power output and engine braking (decompression brake), for example, is already known. The additional valve travel which is then activated/deactivated may then be masked by the mechanically adjusted valve clearance, but will appear when zero-clearance is activated. Use of this method may also be considered in order to activate/deactivate an additional valve travel in order to obtain EGR.

The mechanical valve clearance is on the order of 1–3 mm in a typical engine for a heavier road vehicle or truck, for example. The result of this, however, is that the main valve travel needs to have long rise and fall gradients in an order of magnitude at least equal to the mechanical valve clearance. These long gradients are required in order to avoid knocking in the mechanism at the start of the valve travel and to avoid excessively high valve seat landing speeds at the end of the valve travel for both activated and deactivated zero-clearance adjustment. This also means that the main valve travel remains unchanged when the zero-clearance adjustment is activated/deactivated. If the main valve lift has been optimized for operation with EGR activated (zero-clearance activated), for example, the main lift will no longer be optimal when EGR is deactivated (large mechanical clearance), which has a negative effect on the ability of the turbocharger to supply the engine with charge air in critical operating situations. The long gradients also pose a problem in the case of zero-clearance since the exhaust valve travel commences immediately after maximum cylinder pressure has occurred and this results in extremely high stresses in the valve mechanism in order to open the valve in opposition to high cylinder pressure.

It is desirable that apparatus for achieving additional openings of valves should not extend significantly in a longitudinal direction in the space that is available for the engine valve mechanism. For example, the high compression ratios that occur in modern diesel engines mean that the valve mechanism must be designed for very high contact pressure. Furthermore, engines of this type may be equipped with some form of compression brake that needs space for actuators. Apparatus for exhaust gas recirculation (EGR) should therefore not encroach on any compression brake system. The facility for easy engagement and disengagement of the function is also desirable.

DISCLOSURE OF INVENTION

An object of the present invention is to provide an apparatus which permits exhaust gas recirculation (EGR) in an internal combustion engine within the functional constraints described above. The invention employees a cam curve designed to interact with a second cam follower during a second opening and closing phase. This phase is phase-offset in relation to the first aforementioned opening and closing phase and means that the cylinder can by simple means be connected to the exhaust system during the induction stroke, once the exhaust stroke is completed. As a result, the full cam lift does not have to be repeated when the second cam follower follows the camshaft cam, and it therefore being possible for an upper part of the camshaft cam to perform the required additional lift for the EGR flow.

In one exemplary embodiment of the invention, the cam curve advantageously has a first rising gradient for interaction with the first cam follower during the first opening phase of the exhaust valve and a second rising gradient for interaction with both cam followers during both opening phases of the exhaust valve. The cam curve advantageously also has a first and a second falling gradient essentially corresponding to the rising gradients.

In a further exemplary embodiment of the invention, the two cam followers are mounted on a pivotal (pivot) arm. In this case, the arm may form a cam follower which is located below the cylinder head and is designed to act indirectly on the exhaust valve. Alternatively, the arm may form a rocker arm which is located in the cylinder head and is designed to act directly on the exhaust valve.

In both of these variants, the arm may be provided with a pivotally supported secondary arm that can be shifted between an inactive position and an active position, and which supports the second cam follower. The secondary arm may in this case be shifted hydraulically between the two positions by means of a hydraulic piston. When the second cam follower is activated/deactivated, the movement of the first cam follower toward the camshaft cam remains unaltered in respect of the valve main lift while the second cam follower in the active position in contact with the camshaft cam causes the valve to perform an additional travel.

According to an advantageous exemplary embodiment of the invention, the hydraulic piston is connected to a hydraulic fluid source via a controllable non-return valve. This is suitably designed so that in one operating position the hydraulic fluid can flow in both directions; and in the event of a hydraulic pressure in excess of a specific value, the non-return valve is switched to a second operating position which prevents a return flow of hydraulic fluid, the secondary arm being locked in relation to the arm.

BRIEF DESCRIPTION OF THE DRAWINGS

The invention is described in greater detail hereinbelow, with reference to exemplary embodiments depicted in the accompanying drawings, in which.

MODE FOR THE INVENTION

Figure 1:
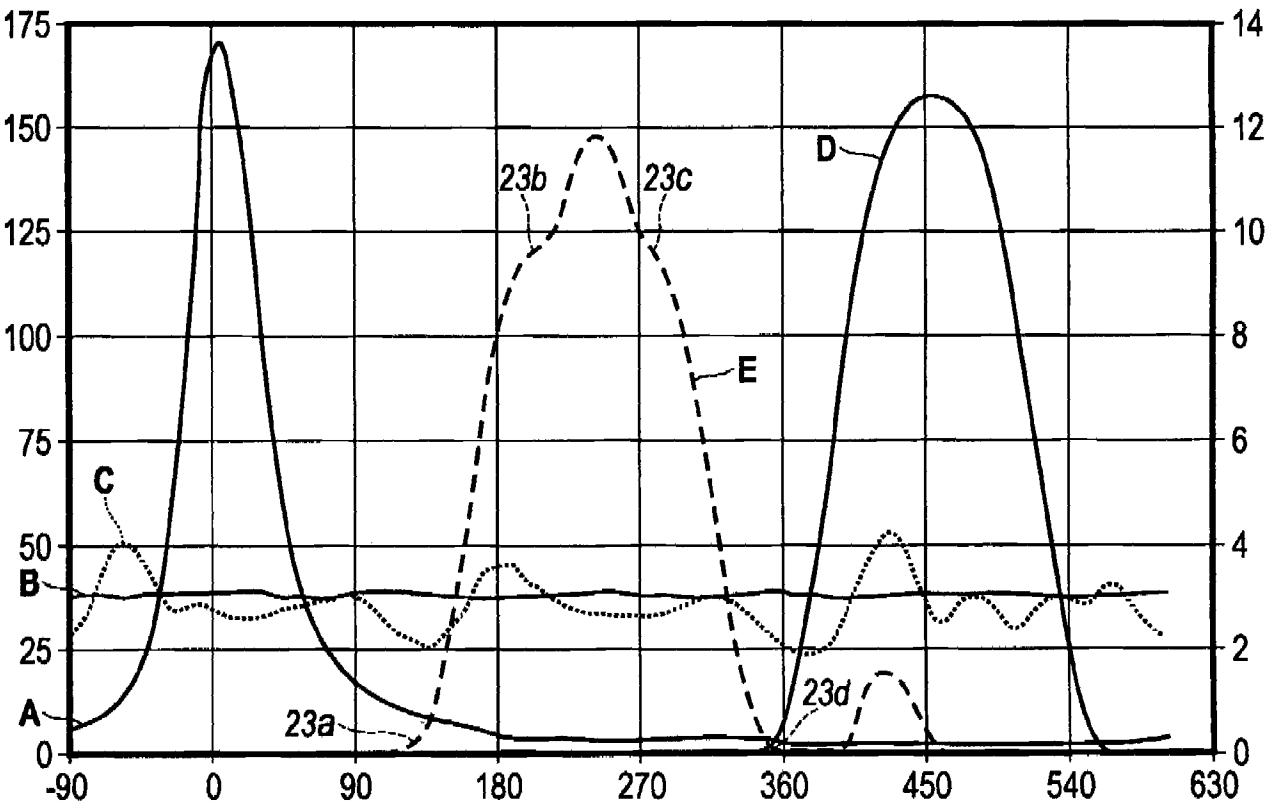
FIG. 1 is a graphical representation of valve functions and pressure ratios in an internal combustion engine with EGR configured according to the teachings of the present invention.

The diagram shown in FIG. 1 illustrates, by means of curve A, the variation in pressure in the cylinders of an engine during an operating cycle of a four-stroke diesel engine. Curve B shows pressure variations on the intake side of a six-cylinder engine. Curve C shows how the pressure varies on the exhaust gas side of the same engine during the operating cycle (split exhaust manifold). Curve D shows the lift curve for the intake valve during the operating cycle and curve E shows the lift curve for the exhaust valve during the operating cycle. It should be appreciated that the y-axis of curve A is situated far to the left of the diagram. Curves B, C, D and E have their y-axis in the right-hand part of the diagram.

It will be apparent from the diagram of FIG. 1 that the exhaust valve, which has its normal lifting movement in the angular interval between approximately 110° and approximately 370°, also has an additional lifting movement which occurs in the interval between approximately 390° and approximately 450°. The pressure on the exhaust gas side (curve C) exhibits its highest pressure value in this interval. This pressure pulse derives from the exhaust gas discharge from the following cylinder in the engine firing order and is therefore used to force EGR gas back into this cylinder just emptied of exhaust gases.

Figure 2:
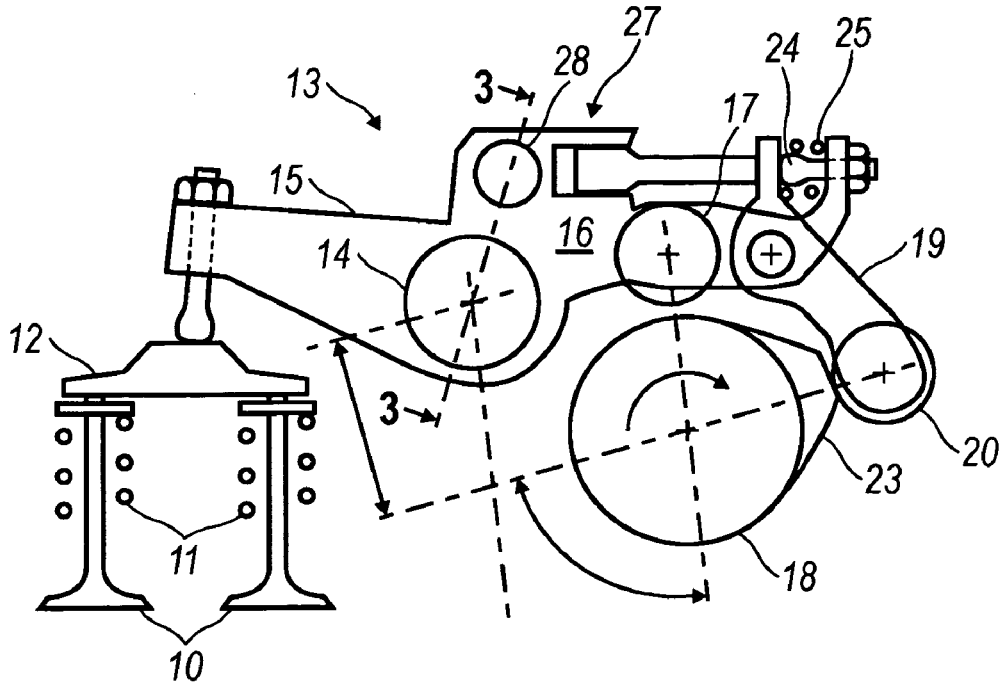
FIG. 2 is a diagrammatic view of a valve mechanism configured according to a first embodiment of the invention, for performing the exhaust gas recirculation according to FIG. 1.

The valve mechanism shown in schematic form in FIG. 2 is located in a cylinder head and comprises double exhaust valves 10 with valve springs 11 and a common yoke 12.

The yoke is acted upon by a rocker arm 13, which is pivotally supported on a rocker arm shaft 14. On one side of the shaft 14, the rocker arm 13 has a valve pressure arm 15 and on the other side a cam follower arm 16 that is provided with a first cam follower in the form of a rocker arm roller 17 which normally interacts with a camshaft 18. The cam follower arm 16 is moreover provided with a secondary arm 19 that is pivotally supported at the outer end of the arm and is provided with a second cam follower in the form of a second rocker arm roller 20.

The secondary arm 19 can be shifted between an inactive position and an active position by means of a hydraulic piston 21 located in the rocker arm as will be described in more detail below with reference to FIG. 3.

In the inactive position (not shown in FIG. 2), the cam 23 of the camshaft 18 acts upon the rocker arm 13 solely by way of the rocker arm roller 17. In the active position (as shown in FIG. 2), the camshaft cam 23 also acts on the rocker arm 13 by way of the second rocker arm roller 20. The geometry, that is to say the length and the angle of the secondary arm 19, is configured so that in the active position, the rocker arm is activated by the camshaft cam 23 at the desired phase angle; exemplarily, at approximately 80–110 degrees later in the direction of rotation of the camshaft 18. The angle of the active position of the secondary arm 19 can be adjusted by means of a stop 24. A compression spring 25 is inserted between the cam follower arm and the secondary arm, in order to bring the secondary arm to bear against the end of the hydraulic piston.

In order to produce two separate lifting movements in an economical manner using one and the same camshaft cam 23, the latter (see FIG. 1, curve E) has a first rising gradient 23*a* for interaction with the first pressure roller 17 during the first opening phase of the exhaust valve, and a second rising gradient 23*b* for interaction with both of the pressure rollers 17, 20 during both opening phases of the exhaust valve 10. In addition, the cam curve 23 has a first and a second falling gradient 23*c*, 23*d* essentially corresponding to the rising gradients 23*a*, 23*b*.

The lift curve is characterized in that the lifting speed increases markedly after the first rising gradient 23*a*. Thereafter, the lifting speed declines and the second rising gradient 23*b* has a moderate lifting speed. After the upper rising gradient 23*b*, the lifting speed again increases before then diminishing to zero at maximum valve lift. With regard to the downward course of the lifting curve, the closing speed only increases after maximum valve lift, and before then being reduced to a lower closing speed at the upper falling gradient 23*c*. After the falling gradient 23*c*, the closing speed again increases before being reduced again at the lower falling gradient 23*d*, finally reaching zero when this second gradient ends. A rising gradient is used when the clearance in the mechanism between cam curve and valve is reduced to zero in connection with the impending valve opening. A falling gradient is used in connection with the valve landing on the valve seat.

Figure 3:
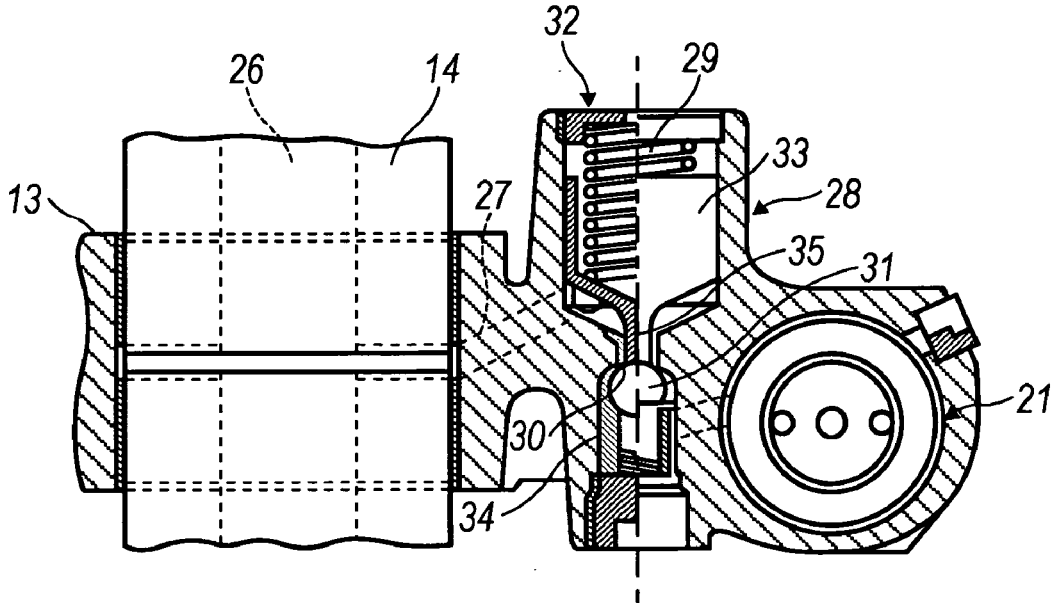
FIG. 3 is a cross-sectional view taken along the line 3—3 in FIG. 2.

Control members of the hydraulic piston 21 can be seen from FIG. 3, which is a section through the rocker arm 13 along the line 3—3 in FIG. 2. This shaft is provided with a duct 26, which connects with a duct 27 in the rocker arm and supplies oil pressure to the pressure cylinder 21 of the hydraulic piston via a controllable non-return valve 28.

The non-return valve 28 acts as a controllable non-return valve. The spring 34 presses a ball 31 against a seat 30. A second spring 29 presses on an operating piston 33 and the spring force in the spring 29 is greater than in the spring 34. This means that at a low hydraulic pressure, the spring 29 and the operating piston 33, with its neb-shaped end section 35, press the ball 31 away from the seat 30 and the hydraulic fluid can flow in both directions. In the event of a hydraulic pressure in excess of a certain specific value, this pressure acting on the operating piston 33 overcomes the force from the spring 29 and the operating piston 33 is pressed against the stop 32. The hydraulic pressure also manages to press the ball 31 away from the seat 30 and passes to the hydraulic piston 21 so as to shift this to the outer position.

When the hydraulic piston 21 has reached its outer position defined by the stop screw 24, the hydraulic flow past the ball 31 ceases. The spring 34 then presses it against the seat 30 and the seal between ball 31 and seat 30 prevents any return flow of hydraulic fluid. The secondary arm 19 is then locked in relation to the cam follower arm 16.

The non-return valve 28 is therefore designed to be deactivated (to permit flow in both directions) in the event of hydraulic fluid pressure in the hydraulic fluid duct 26, 27 less than a specific value. The non-return valve 28 is designed to be activated (to permit flow in only one direction) in the event of a hydraulic fluid pressure in the hydraulic fluid duct in excess of the aforementioned specific value. This means that the hydraulic piston 21 can be pushed out by the hydraulic pressure when the secondary rocker arm 19 is not in contact with the camshaft cam 23, but can be blocked in the reverse direction of the non-return valve when the camshaft cam is in contact with the secondary rocker arm 19. By controlling the pressure in the duct 26, the secondary arm can accordingly be brought by the hydraulic piston 21 to assume an active position in which the rocker arm 13 and the secondary arm are hydraulic locked to one another. When the pressure increases again, hydraulic fluid can be released from the hydraulic piston 21 back to the duct 26.

In an engine which is equipped both with the system of exhaust gas recirculation (EGR) described above and a conventional compression brake of the type, for example, described in the published patent application SE 470363, two separate lubricating oil supplies are required to a rocker arm having two different non-return valves 28 as described above.

Figure 4:
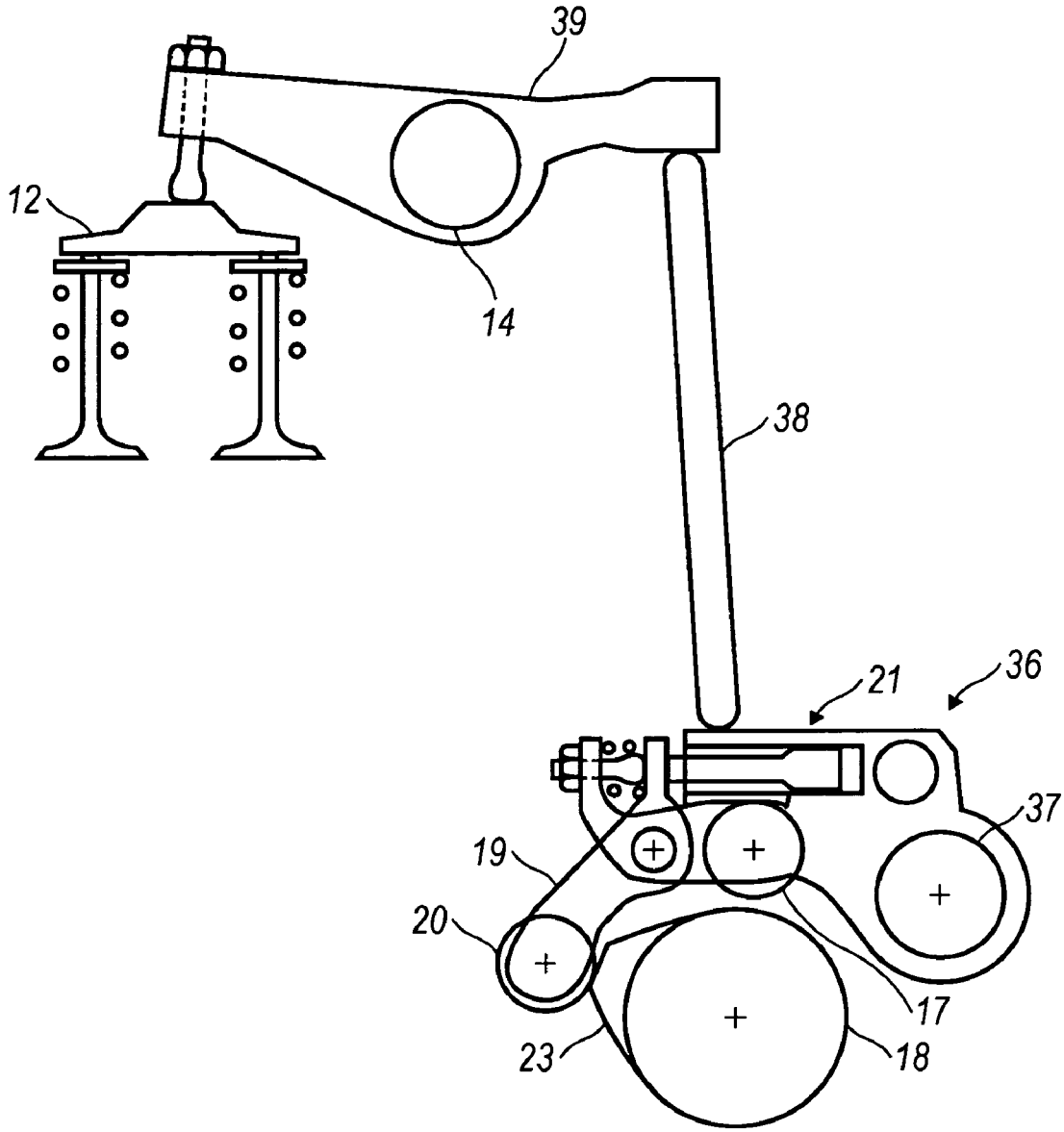
FIG. 4 is a diagrammatic view of a valve mechanism configured according to a second variant (embodiment) of the invention.

FIG. 4 shows a variant of the valve mechanism in which a cam follower 36 is mounted below the cylinder head on a shaft 37. The valve yoke 12 is acted upon by way of a push rod 38 and a rocker arm 39. In the same way as is provided by the exemplary rocker arm 13 in FIG. 2, the cam follower 36 of FIG. 4 is provided with a secondary arm 19 with pressure roller 20. The secondary arm 19 can, in the manner described above, shift between an inactive position and an active position under the action of the hydraulic piston 21.

The present invention should not be regarded as being limited to the exemplary embodiments described above, but a number of further variants and modifications are contemplated as being feasible and still within the scope of the patent claims. For example, the second cam follower 20 may be operated in some way other than via a pivotal arm 19, for example by a linear movement, and this movement need not be performed hydraulically, but may be achieved by electrical or mechanical means.

The invention claimed is:

1. An arrangement for delivering EGR gas to a combustion engine, said arrangement comprising:

a four-stroke internal combustion engine having multi-cylinders, each of said cylinders comprising:

a combustion space, an associated piston, and at least one inlet valve and at least one exhaust valve (10) for controlling connection between the combustion space in the cylinder and an intake system and an exhaust system, respectively; and a rotatable camshaft (18) having a cam curve (23) having a first rising gradient (23*a*) configured to interact with a first cam follower (17) for operating the respective at least one exhaust valve (10) during a first opening and closing phase, the cam curve (23) being further configured to interact with a second cam follower (20) during a second opening and closing phase that is phase-offset in relation to the first opening and closing phase, the cam curve having a second rising gradient (23*b*) that interacts with both cam followers (17, 20) during both opening phases of the exhaust valve (10), which connects the cylinder with the exhaust system during the induction stroke after the exhaust stroke is completed.

2. An arrangement for delivering EGR gas to a combustion engine, said arrangement comprising:

a four-stroke internal combustion engine having multi-cylinders, each of said cylinders comprising:

a combustion space, an associated piston, and at least one inlet valve and at least one exhaust valve (10) for controlling connection between the combustion space in the cylinder and an intake system and an exhaust system, respectively; and a rotatable camshaft (18) having a cam curve (23) configured to interact with a cam follower (17) for operating the respective at least one exhaust valve (10) during a first opening and closing phase, the cam curve (23) being further configured to interact with a second cam follower (20) during a second opening and closing phase that is phase-offset in relation to the first opening and closing phase and which connects the cylinder with the exhaust system during the induction stroke after the exhaust stroke is completed, wherein the cam followers (17, 20) are mounted on a pivotal arm.

3. An arrangement for delivering EGR gas to a combustion engine, said arrangement comprising:

a four-stroke internal combustion engine having multi-cylinders, each of said cylinders comprising:

a combustion space, an associated piston, and at least one inlet valve and at least one exhaust valve (10) for controlling connection between the combustion space in the cylinder and an intake system and an exhaust system, respectively; and a rotatable camshaft (18) having a cam curve (23) configured to interact with a cam follower (17) for operating the respective at least one exhaust valve (10) during a first opening and closing phase, the cam curve (23) being further configured to interact with a second cam follower (20) during a second opening and closing phase that is phase-offset in relation to the first opening and closing phase and which connects the cylinder with the exhaust system during the induction stroke after the exhaust stroke is completed.

4. The arrangement as recited in claim 3, further comprising:

the cam curve having a first rising gradient (23*a*) that interacts with the first cam follower (17) during the first opening phase of the exhaust valve; and the cam curve having a second rising gradient (23*b*) that interacts with both cam followers (17, 20) during both opening phases of the exhaust valve (10).

5. The arrangement as recited in claim 4, further comprising:

the cam curve (23) having a first and a second falling gradient (23*c*, 23*d*) essentially corresponding to the rising gradients (23*a*, 23*b*).

6. The arrangement as recited in claim 3, wherein the cam followers (17, 20) are mounted on a pivotal arm.

7. The arrangement as recited in claim 6, wherein the pivotal arm forms a rocker arm (13) located in the cylinder head and being configured to act directly on the exhaust valve (10).

8. The arrangement as recited in claim 6, wherein the pivotal arm forms a cam follower (36) located beneath a respective cylinder head and which is configured to indirectly act on the exhaust valve (10) by way of a push rod (38) and a rocker arm (39).

9. The arrangement as recited in claim 8, wherein the pivotal arm has a pivotally supported secondary arm (19) shiftable between an inactive position and an active position and which supports the second cam follower (20).

10. The arrangement as recited in claim 9, wherein the secondary arm (19) is hydraulically shiftable between the active and inactive positions by an hydraulic piston (21).

11. The arrangement as recited in claim 10, wherein the hydraulic piston (21) is connected to a hydraulic fluid source by a hydraulic fluid duct (26, 27) and a controllable non-return valve (28).

12. The arrangement as recited in claim 11, wherein the controllable non-return valve (28) is configured so that in one operating position, the hydraulic fluid is permitted to flow in both directions, and in the event of hydraulic pressure in excess of a certain specific value, the non-return valve switches to a second operating position which prevents a return flow of hydraulic fluid, the secondary arm (19) being locked in relation to the arm (13; 36).

* * * * *